US008998121B2

(12) United States Patent
Davis et al.

(10) Patent No.: US 8,998,121 B2
(45) Date of Patent: Apr. 7, 2015

(54) REEL STAND BRAKE SYSTEM

(75) Inventors: Gerald H. Davis, Fountain City, IN (US); Chad L. Eversole, Richmond, IN (US); Gary L. Cox, Richmond, IN (US)

(73) Assignee: Vandor Corporation, Richmond, IN (US)

( * ) Notice: Subject to any disclaimer, the term of this patent is extended or adjusted under 35 U.S.C. 154(b) by 851 days.

(21) Appl. No.: 13/100,686

(22) Filed: May 4, 2011

(65) Prior Publication Data

US 2012/0104139 A1 May 3, 2012

Related U.S. Application Data

(60) Provisional application No. 61/331,215, filed on May 4, 2010.

(51) Int. Cl.
*B65H 75/30* (2006.01)
*B65H 75/44* (2006.01)

(52) U.S. Cl.
CPC ..... *B65H 75/4444* (2013.01)

(58) Field of Classification Search
CPC ..... B65H 75/406; B65H 49/00; B65H 49/32; B65H 49/26; B65H 75/44; B65H 75/30; B65H 75/18; B65H 75/38
USPC ..... 242/422, 422.4, 421.8, 421.9, 396, 242/396.1, 396.4, 396.5, 396.6
See application file for complete search history.

(56) References Cited

U.S. PATENT DOCUMENTS

| | | | | | |
|---|---|---|---|---|---|
| 403,344 | A | * | 5/1889 | Gayhart | 242/395.1 |
| 426,434 | A | * | 4/1890 | Campbell | 242/396.1 |
| 743,001 | A | * | 11/1903 | Knight et al. | 242/396.1 |
| 1,754,786 | A | * | 4/1930 | East | 254/369 |
| 1,784,064 | A | * | 12/1930 | Griswold | 242/396.1 |
| 1,844,673 | A | * | 2/1932 | Nicewonger | 242/396.4 |
| 2,973,941 | A | * | 3/1961 | Lunde | 242/388.5 |
| 3,085,767 | A | * | 4/1963 | Zerbest | 242/396.1 |
| 4,610,407 | A | * | 9/1986 | Stubbmann | 242/421.3 |
| 5,060,882 | A | * | 10/1991 | Rousculp et al. | 242/421.3 |
| 2011/0101148 | A1 | * | 5/2011 | Allwood | 242/422 |

* cited by examiner

*Primary Examiner* — William A Rivera
(74) *Attorney, Agent, or Firm* — Maginot, Moore & Beck, LLP

(57) ABSTRACT

A braking mechanism for a reel stand has been developed. The braking mechanism is affixed to a reel support member. The reel support member is configured to rotatably support at least a part of a reel. The braking mechanism includes a brake lever connected to the reel support member at a pivot point, and a braking member connected to the brake lever. The pivot point is offset from an axis of rotation of a reel supported by the reel support member. The braking member is configured to be positionable against the reel supported by the reel support member with an adjustable braking force.

25 Claims, 6 Drawing Sheets

REEL STAND BRAKE SYSTEM

This application claims the benefit of priority to U.S. provisional patent application Ser. No. 61/331,215, filed May 4, 2010, the disclosure of which is incorporated herein by reference in its entirety.

FIELD

The present disclosure relates generally to reels for paying out a wound flexible medium, and particularly to a brake system for controlling the payout rate of the wound flexible medium.

BACKGROUND

Reels for supporting a wound flexible medium are used to store and facilitate the dispensing of mediums such as rope, wire, chain, and strings of parts. In general, a reel includes a core and two flanges. The flexible medium is wound around the core, and the two flanges prevent the wound flexible medium from migrating off the core in an axial direction. Reels having a medium wound thereon vary greatly in size and weight from lightweight reels that are easily manipulated by hand to heavyweight reels that are movable only with mechanical assistance.

Technicians frequently use a reel stand to rotatably support a reel during the distribution of the flexible medium wound about the reel. The reel stand supports the reel with which it, is associated and enables the reel to rotate as a technician or other user pays out the flexible medium from the reel.

A reel stand may include a braking mechanism for controlling the rotation of the reel relative to the reel stand. A continuing need to improve reel stands makes it desirable to develop a braking mechanism, which effectively controls the payout rate of the reel, but that does not significantly increase the cost or the complexity of the reel stand.

SUMMARY

In accordance with one embodiment of the disclosure, a braking mechanism is affixed to a reel support member configured to rotatably support at least a part of a reel. The braking mechanism includes a brake lever connected to the reel support member at a pivot point, and a braking member connected to the brake lever. The pivot point is offset from an axis of rotation of a reel supported by the reel support member. The braking member is configured to be positionable against the reel supported by the reel support member with an adjustable braking force.

Pursuant to another embodiment of the disclosure, there is provided a reel support member configured to rotatably support at least a part of a reel. The reel support member includes a frame and a hub connected to the frame. The reel support member further includes a brake lever connected to the hub at a pivot point, and a braking member connected to the brake lever. The frame is configured to support the reel about an axis of rotation, and the pivot point is offset from the axis of rotation. The braking member is positionable against the reel with an adjustable braking force.

According to yet another embodiment of the disclosure, there is provided a reel support member configured to rotatably support at least a part of a reel. The reel support member includes a frame and a brake body connected to the frame and defining a brake opening. The reel support member further includes a brake lever connected to the brake body at a pivot point, and a braking member connected to the brake lever. The frame is configured to support the reel about an axis of rotation. The pivot point is offset from the axis of rotation, and the braking member is configured to be positionable against the reel through the brake opening with an adjustable braking force.

DETAILED DESCRIPTION

Figure 1:
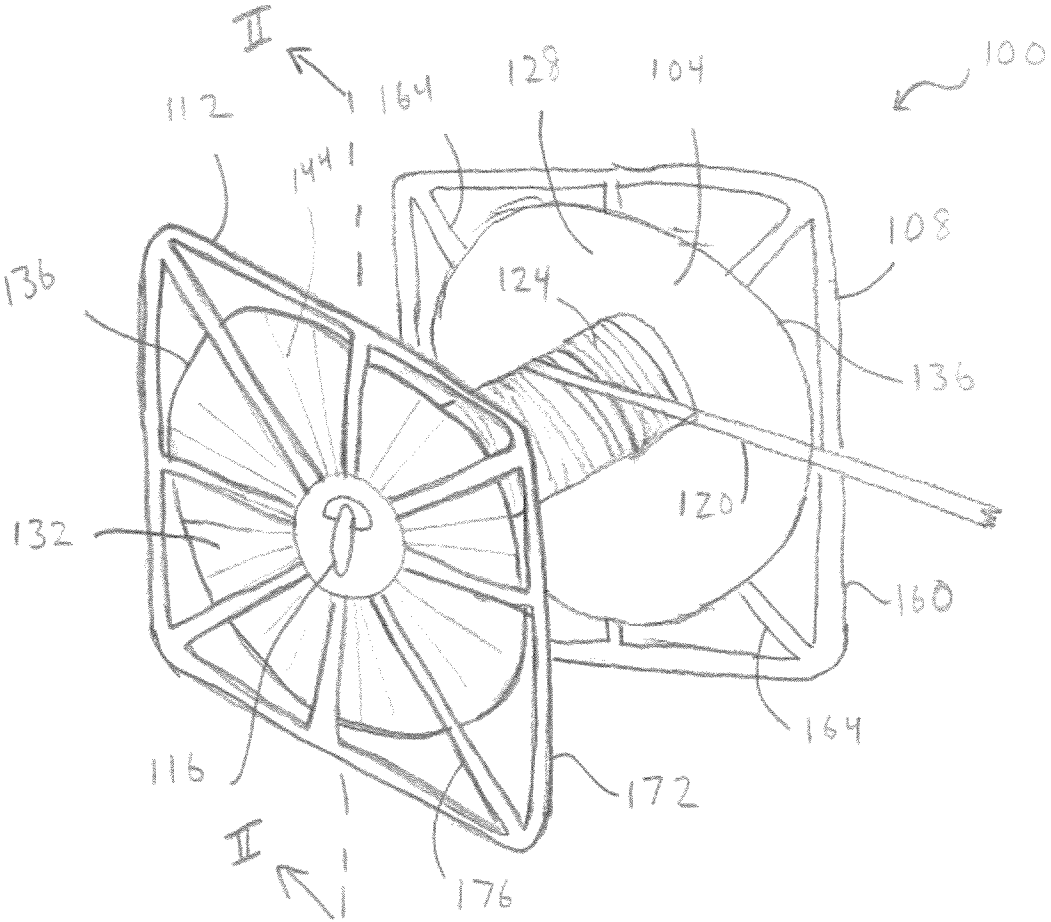
FIG. 1 shows a perspective view of a reel and a reel stand assembly, the reel stand assembly including a braking mechanism.

As shown in FIG. 1, a reel stand assembly 100 rotatably supports a reel 104 with a left and a right reel support member 108, 112. The reel stand assembly 100 includes a braking mechanism 116 associated with the right reel support 112. The braking mechanism 116 enables a user of the reel stand assembly 100 to apply an adjustable braking force to the reel 104 in order to control the payout rate of a wound material 120 stored on the reel 104. Each component of the reel stand assembly 100 and the reel 104 is described below.

Figure 2:
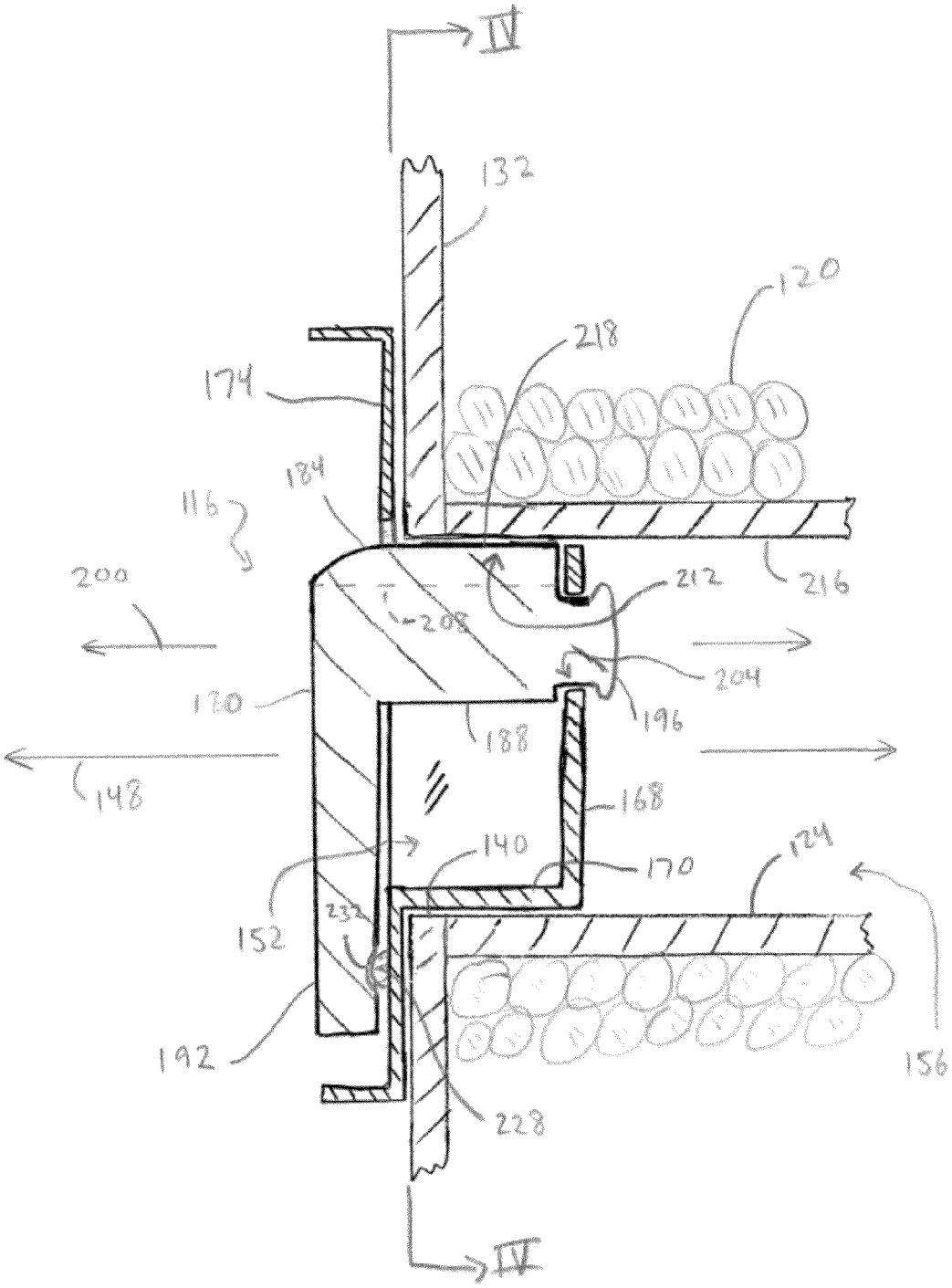
FIG. 2 is a cross sectional view of a portion of the reel and the reel stand assembly taken along the line II-II of FIG. 1.

The reel 104 is configured to support the wound material 120 and includes a core portion 124 connected to a left flange 128 and a right flange 132. The flanges 128, 132 are generally flat structures each having an outer rim 136 and an inner rim 140 (FIG. 2). The flanges 128, 132 include numerous ribs 144, which extend between the inner rim 140 and the outer rim 136. The ribs 144 are configured to increase the rigidity of the flanges. The flanges 128, 132 are formed from injection molded thermoplastic; however, in alternative embodiments the flanges are formed from wood, cardboard, metal, or any other sufficiently rigid material.

As shown in FIG. 2, the inner rim 140 of the right flange 132 defines an arbor opening 152, which is approximately the same diameter as an inner diameter of the core 124. A portion of the braking mechanism 116 extends through the arbor opening 152. Although not shown in the figures, the inner rim of the left flange 128 defines a substantially identical arbor opening, such that the braking mechanism 116 may be inserted through the arbor opening in the left flange. When the braking mechanism 116 is associated with the left flange 128, it functions substantially identically to when the braking mechanism is associated with the right flange 132.

The core 124 defines an axis of rotation 148 of the reel 104. The core 124 is generally cylindrical and extends between the left flange 128 and the right flange 132. The core 124 is disposed radially interior from an outer edge (i.e. the outer rim 136) of the flanges 128, 132. The core 124 defines an internal space 156 into which a portion of the braking mechanism 116 extends, as shown in FIG. 2. The core 124 is formed from injection molded thermoplastic. in other embodiments of the reel 104, the core 124 may be formed from wood, cardboard, metal, or any other sufficiently rigid material. Exemplary wound materials 120 that may be stored on the core 124 include rope, wire, chain, or strings of parts.

With reference again to FIG. 1, the left reel support 108 includes a hub assembly (not shown, but substantially identical to the hub assembly 168 described below), an outer frame 160, and numerous spokes 164. At least a portion of the hub assembly extends through the arbor opening in the left flange 128 and is configured to axially support the left side of the reel 104. The outer frame 160 is generally rectangular. The perimeter portions of the outer frame 160 have a length that is greater than a diameter of the left flange 128, such that the reel support 108 positions the reel 104 above ground level. The spokes 164 extend between the hub assembly and the outer frame 160 to support the hub assembly.

The right reel support 112 includes a hub assembly 168, an outer frame 172, numerous spokes 176, and the braking mechanism 116. As shown in FIG. 2, the hub assembly 168 includes an axial support 170 and a hub front 174. The axial support 170 is a generally cylindrical structure configured to be received through the arbor opening 152 of the right flange 132 and into the internal space 156 defined by the core 124. Accordingly, the axial support 170 has a diameter that is less than a diameter of the arbor opening 152 and less than the diameter of the internal space 156. The hub front 174 is generally disposed on the same plane as the outer frame 172 and the spokes 176. Stated another way, the hub front 174 is disposed outside of the axial extent of the right flange 132 when the right flange is rotatably associated with the axial support 170.

The outer frame 172 of the right reel support 112 is generally rectangular. The perimeter portions of the outer frame 172 have a length that is greater than a diameter of the right flange 132, such that the reel support 112 positions the reel 104 above ground level. The spokes 176 extend between the hub assembly 168 and the outer frame 172 to support the hub assembly.

The braking mechanism 116 is configured to enable a user of the reel stand assembly 100 to control the payout rate of the wound material 120 by controlling the force needed to rotate the reel 104 relative to the reel supports 108, 112. The braking mechanism 116 includes a brake lever 180 and a braking member 184.

As shown in FIG. 2, the brake lever 180 includes a pivot portion 188 connected to a handle 192. The pivot portion 188 is pivotally connected to the axial support 170 and is configured for movement about a pivot point 196, which defines a pivot axis 200. The pivot point 196 is received by a pivot opening 204 in the axial support 170. The pivot point 196 and pivot axis 200 are not concentrically located with the axis of rotation 148 of the reel 104. In other words, the pivot point 196 and the pivot axis 200 are offset from the axis of rotation 148 of the core 124, when the reel is affixed to the reel support 112 or the reel support 108. The handle 192 provides a user of the braking mechanism 116 with leverage for rotating the brake lever 180 about the pivot axis 200.

Figure 3:
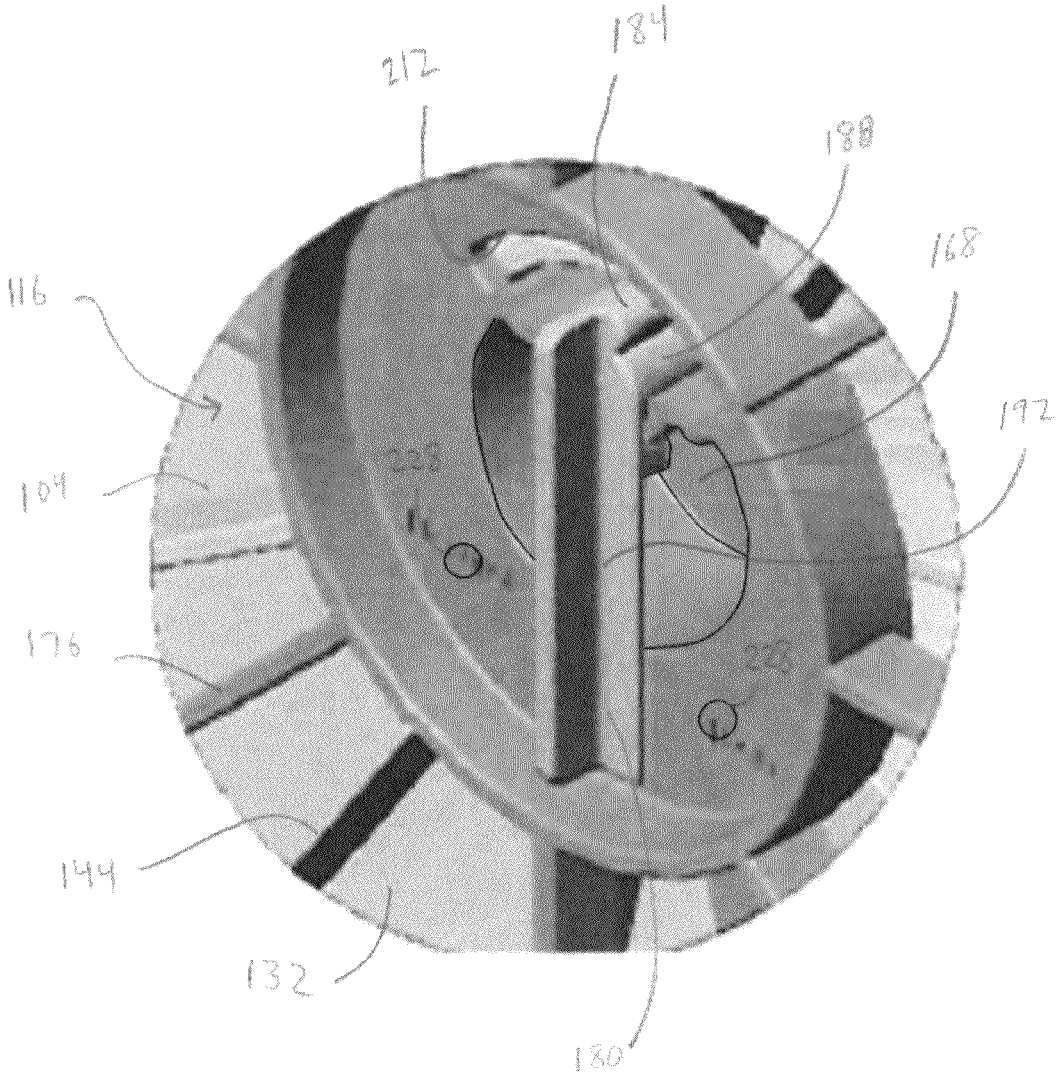
FIG. 3 shows a perspective view of the braking mechanism of FIG. 1.

As shown in FIGS. 2 and 3, the braking member 184 is connected to the pivot portion 188 at an end portion of the braking lever 180. In FIG. 2, the broken line 208 identifies the boundary between pivot portion 188 and the braking member 184. The braking member 184 is positionable to extend through a brake opening 212 formed in the axial support 170 of the hub assembly 168. In particular, rotation of the brake lever 180 moves the braking member 184 through the brake opening 212 and positions the braking member into/out of contact with an inner surface 216 of the core 124.

Figures 4A, 4B, 4C:
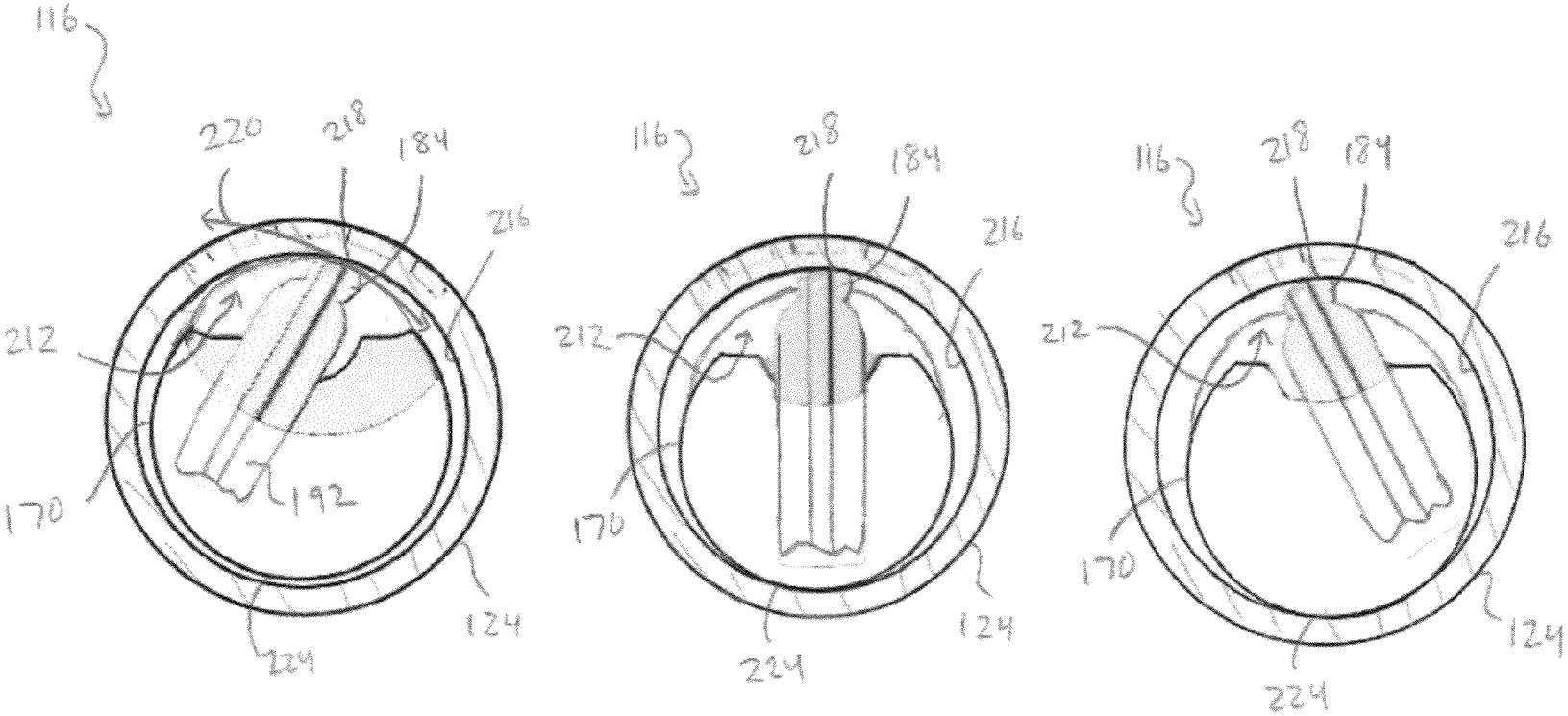
FIG. 4A shows a cross sectional view of the braking mechanism taken along the line IV-IV of FIG. 2, with the braking mechanism in a "no brake" position.
FIG. 4B shows a cross sectional view of the braking mechanism taken along the line IV-IV of FIG. 2, with the braking mechanism in a "low brake" position.
FIG. 4C shows a cross sectional view of the braking mechanism taken along the line IV-IV of FIG. 2, with the braking mechanism in a "high brake" position.

As shown in FIG. 4A, the braking member 184 defines an asymmetrical cross section with respect to a plane of rotation that is perpendicular to the axis of rotation 148. The asymmetrical cross section defines a brake surface 218 that is configured to engage an inner diameter of the arbor opening 152 and/or the inner surface 216 of the core 124. The asymmetrical shape of the braking member 184, in combination with the pivot axis 200 being offset from the axis of rotation 148, enables the braking mechanism 116 to apply an adjustable braking force to the reel 104. In particular, rotation of the brake lever 180 about the pivot axis 200 moves the braking member 184 along the curved path 220. The curved path 220 intersects the inner surface 216 of the core 124. Accordingly, as the brake lever 180 is rotated in a counterclockwise direction (in relation to FIGS. 4A, 4B, 4C) the braking member 184 becomes positioned increasingly higher above the axial support 170, thereby enabling the braking member to apply an adjustable/selectable braking force to the reel 104. Three positions of the brake lever 180 are described below and illustrated in FIGS. 4A, 4B, and 4C.

With reference to FIG. 4A, the braking mechanism 116 is in a "no brake" position. In the "no brake" position the braking member 184 does contact or engage the inner surface 216 of the core 124 or, at most, contacts or engages the inner surface in a minimal way. As a consequence, the core 124 (and the rest of the reel 104) freely rotates about the axial support 170 of the hub assembly 168 relative to the left and the right reel supports 108, 112.

In the "low braked" position, as shown in FIG. 4B, the braking member 184 extends above the axial support 170 through the brake opening 212. The brake surface 218 of the braking member 184 is positioned in contact with the inner surface 216 of the core 124. The braking member 184 increases the rotational resistance between the reel 104 and the axial support 170 by applying an approximately upwardly directed force to the core 124, which forces the brake surface 218 and the bottom surface 224 of the axial support 170 against the inner surface 216 of the core 124. Friction between the braking surface 218 and the inner surface 261 and friction between the axial support 170 and the inner surface 216 increases the rotational resistance of the reel 104 such that the payout rate of the reel may be controlled.

In the "high braked" position, as shown in FIG. 4C, the braking mechanism 116 prevents the reel 104 from rotating relative to the left and the right reel supports 108, 112. Specifically, the brake lever 180 is rotated to position the braking member 184 further above the axial support 170 (through the brake opening 212) than in the "low braked" position, such that the friction between the braking surface 218 and the inner surface 216 of the core and the friction between the axial support 170 and the inner surface of the core resists rotation of the reel 104 relative to the left and the right reel supports 108, 112. As shown in FIG. 4C, the increased frictional force occurs, at least in part, as a result of the braking surface 218 being forced against the inner surface 216 of the core 124 with a braking force greater than the braking force associated with the "low braked" position.

With reference again to FIGS. 2 and 3, the hub front 174 includes numerous detents 228 (and/or other features) configured to releasably secure the brake lever 180 in one of the "no brake," the "low brake," and the "high brake positions." The detents 228 are protrusions formed in the hub front 174. The detents 228 are sized to fit within a recess 232 formed in the brake lever 180. When the brake lever 180 is engaged with a detent 228, the position of the brake lever (and the braking member 184) is fixedly maintained without user effort. The brake lever 180 may be formed from a resilient material to enable the brake lever to bend/flex slightly when separating the recess 232 from one of the detents 228. Exemplary resilient materials include injection molded thermoplastic, and the like. Other embodiments of the braking mechanism 116 may include additional detents or no detents.

In operation, the reel stand assembly 100 enables a technician or other user to easily control the payout rate of the wound material 120. First, the reel stand assembly 100 is connected to the reel 104. In particular, the left reel support 108 is connected to the reel 104 by inserting the axial support of the hub assembly through the arbor opening in the left flange 128. The right reel support 112 is connected to the reel 104 by moving the brake lever 180 to the "no brake" position and then inserting the axial support 170 of the hub assembly 168 through the arbor opening 152 in the right flange 132.

After the reel supports 108, 112 have been connected to the reel 104, the braking mechanism 116 may be used to control the rotation of the reel relative to the reel supports. If no rotation of the reel 104 is desired, as occurs during transportation or storage of the reel, the brake lever 180 is moved to the "high braked" position, which prevents rotation of the reel.

During payout of the wound material 120, the braking mechanism 116 allows a user to apply an adjustable braking force to the reel 104 by positioning the brake lever 180 between the "no brake" position and the "high brake" position. The braking force is useful for preventing a backlash of the wound material 120 from occurring. A backlash occurs when the inertia of the reel 104 causes the reel to rotate at a rate greater than the rate at which the wound material 120 is withdrawn from the reel. At the first sign of backlash a user increases the breaking force by rotating the brake lever 180 in the counterclockwise direction (in relation to FIGS. 4A, 4B, 4C), such that that rotational rate of the reel is decreased to approximately equal the payout rate of the wound material 120.

In another embodiment of the reel stand assembly 100, both the left support member 108 and the right support member 112 include one of the braking mechanisms 116. Accordingly, the payout rate of the wound material 120 can be controlled from either or both sides of the reel 104.

In yet another embodiment of the reel stand assembly 100 the pivot axis 200 is aligned with the axis of rotation 148. The braking mechanism 116 is still able to apply an adjustable braking force to the reel 104 due to the asymmetrical shape of the braking member 184. Accordingly, at least some operational advantages of the reel stand assembly 100 do not require an offset pivot point 196.

Figure 5:
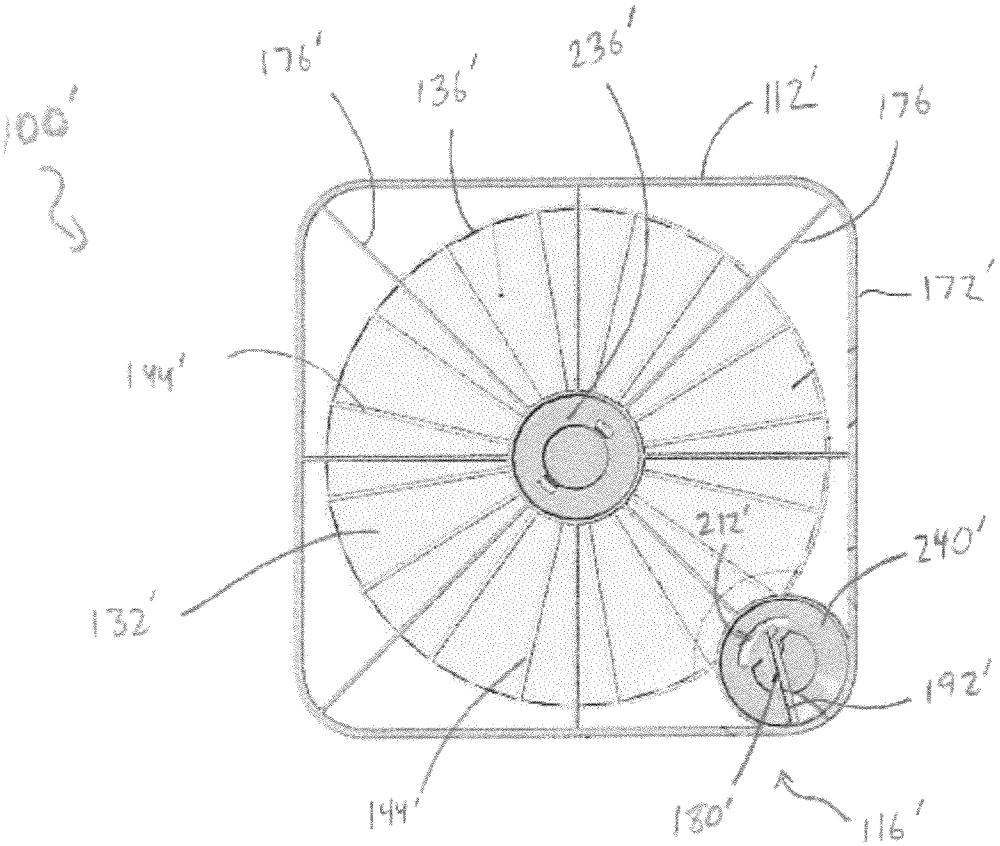
FIG. 5 shows a side elevational view of an alternative embodiment of the reel and reel stand assembly of FIG. 1.
Figure 6:
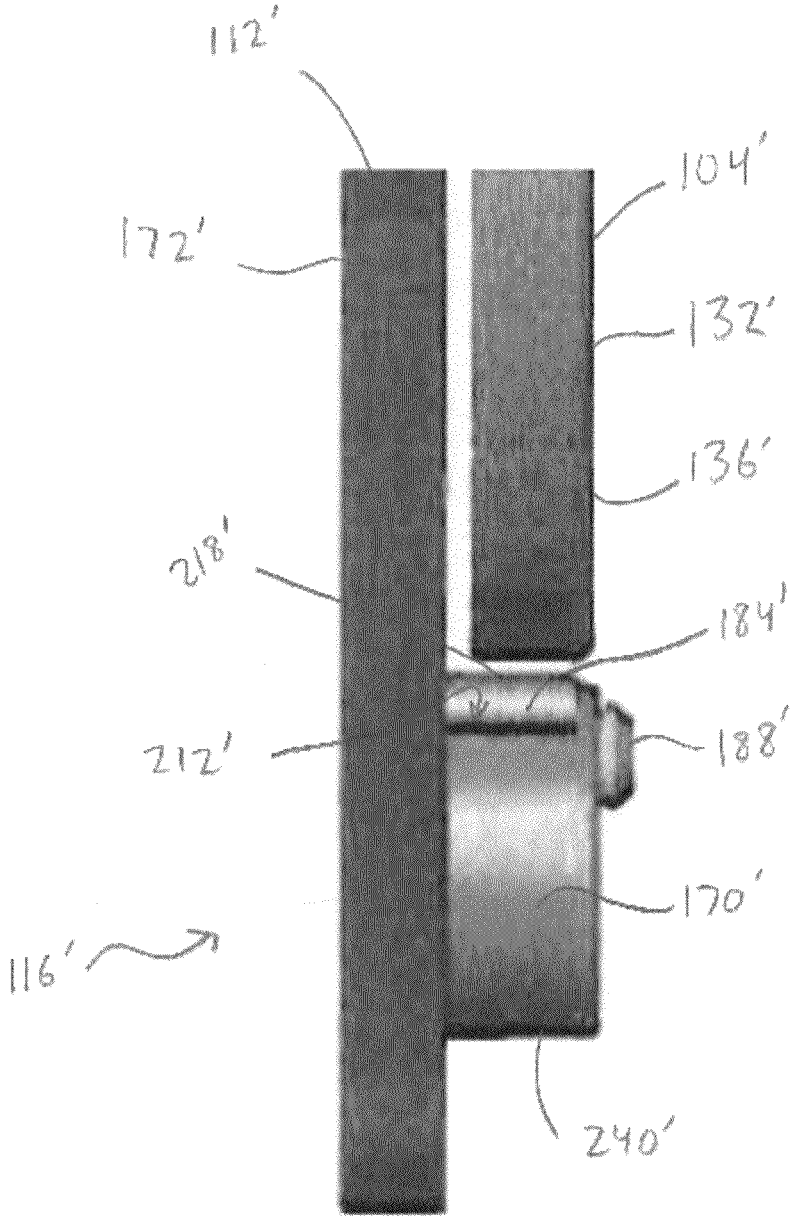
FIG. 6 shows a front elevational view of a braking mechanism of the reel stand assembly of FIG. 5.

An alternative embodiment of reel stand assembly 100' is shown in FIGS. 5 and 6. The reel stand assembly 100' includes a left reel support (not shown) that is the same as the left reel support 108. The right reel support 112' includes an outer frame 172' and spokes 176' that are the same as the outer frame 172 and the spokes 176. The right reel support 112' also includes an axial support 236'. The axial support 236' is a generally cylindrical structure and has a diameter that is less than a diameter of the arbor opening 152' in the right flange 132' and less than the diameter of the internal space 156'. The axial support 236' extends through the arbor opening 152' in the right flange 132' and into the internal space 156' defined by the core 124'.

A braking mechanism 116' is associated with the right reel support 112' and includes a brake body 240' and a brake lever 180'. The brake body 240' is positioned in a corner of the outer frame 172'. The brake body 240' defines a brake opening 212'. The brake lever 180' is substantially identical to the brake lever 180. The brake body 240' is not configured to axially support the reel 104'.

As shown in FIG. 6, the braking mechanism 116' functions similarly to the braking mechanism 116, except that instead of the brake surface 218' moving into and out of contact with the inner surface 216 of the core 124, the brake surface 218' is positionable to contact the outer rim 136' of the right flange 132'. When the brake lever 180' is in the "no brake" position the braking member 184' does not contact or, at most, contacts or engages the outer rim 136' in a minimal way. When the brake lever 180' is in the "low brake" position, the braking member 184' extends through the brake opening 212' and the brake surface 218' is positioned in contact with the outer rim 136' with a first braking force. When the brake lever 180' is in the "high brake" position, the brake surface 218' is positioned in contact with the outer rim 136' with a second braking force that is greater than the first braking force. Friction between the brake surface 218' and the outer rim 136' enables a user of the reel stand assembly 100' to control the payout rate of the wound material 120'. It is noted that the braking mechanism 116' and brake body 240' may be positioned in any corner of the outer frame 172', and the pivot point 196' of the brake lever 180' may be anywhere that suitably allows the brake lever to rotate to different levels of engagement using the asymmetrical brake surface 218'.

The device described herein has been illustrated and described in detail in the figures and foregoing description, the same should be considered as illustrative and not restrictive in character. It is understood that only the preferred embodiments have been presented and that all changes, modifications, and further applications that come within the spirit of the device described herein are desired to be protected.

What is claimed is:

1. A braking mechanism affixed to a reel support member, the reel support member configured to rotatably support at least a part of a reel, the braking mechanism comprising:

a brake lever connected to the reel support member at a pivot point and configured to rotate about a pivot axis; and a braking member connected to the brake lever, wherein the pivot point is offset from an axis of rotation of the reel supported by the reel support member, wherein the pivot axis is parallel to the axis of rotation of the reel, and wherein the braking member is configured to be positionable against the reel supported by the reel support member with an adjustable braking force.

2. The braking mechanism of claim 1, wherein the braking member defines an asymmetrical cross section with respect to a plane of rotation perpendicular to the axis of rotation.

3. The braking mechanism of claim 1, wherein: the reel includes a core portion centered about the axis of rotation and disposed radially interior from an outer edge of the reel, and the braking member is positionable against the core portion.

4. The braking mechanism of claim 1, wherein: the reel includes a flange portion, and the braking member is positionable against the flange portion.

5. The braking mechanism of claim 1, wherein the braking member is connected to an end portion of the brake lever.

6. The braking mechanism of claim 1, further comprising:

a detent connected to the reel support member and configured to secure the brake lever in a first position, wherein the braking member is positioned against the reel with a first braking force in response to the detent securing the brake lever in the first position.

7. The braking mechanism of claim 6, wherein the brake lever is formed from a resilient material.

8. The braking mechanism of claim 6, further comprising:

a second detent connected to the reel support member and configured to secure the brake lever in a second position, wherein the braking member is positioned against the reel with a second braking force in response to the detent securing the brake lever in the second position.

9. A reel support member configured to rotatably support at least a part of a reel, comprising:

a frame;

a hub connected to the frame;

a brake lever connected to the hub at a pivot point; and a braking member connected to the brake lever, wherein the frame is configured to support the reel about an axis of rotation, wherein the pivot point is offset from the axis of rotation, and wherein the braking member is positionable against the reel with an adjustable braking force.

10. The reel support member of claim 9, wherein the braking member defines an asymmetrical cross section with respect to a plane of rotation perpendicular to the axis of rotation.

11. The braking mechanism of claim 10, wherein: the reel includes a core portion centered about the axis of rotation and disposed radially interior from an outer edge of the reel, and the braking member is positionable against the core portion.

12. The braking mechanism of claim 10, wherein: the reel includes a flange portion, and the braking member is positionable against the flange portion.

13. The braking mechanism of claim 10, wherein the braking member is connected to an end portion of the brake lever.

14. The braking mechanism of claim 9, further comprising:

a detent connected to the reel support member and configured to secure the brake lever in a first position, wherein the braking member is positioned against the reel with a first braking force in response to the detent securing the brake lever in the first position.

15. The braking mechanism of claim 14, wherein the brake lever is formed from a resilient material.

16. The braking mechanism of claim 14, further comprising:

a second detent connected to the reel support member and configured to secure the brake lever in a second position, wherein the braking member is positioned against the reel with a second braking force in response to the detent securing the brake lever in the second position.

17. The reel support member of claim 9, wherein the brake lever is configured to rotate about a pivot axis which is parallel to the axis of rotation.

18. A reel support member configured to rotatably support at least a part of a reel, comprising:

a frame;

a brake body connected to the frame and defining a brake opening;

a brake lever connected to the brake body at a pivot point; and a braking member connected to the brake lever, wherein the frame is configured to support the reel about an axis of rotation, wherein the pivot point is offset from the axis of rotation, and wherein the braking member is configured to be positionable against the reel through the brake opening with an adjustable braking force.

19. The braking mechanism of claim 18, wherein the braking member defines an asymmetrical cross section with respect to a plane of rotation perpendicular to the axis of rotation.

20. The braking mechanism of claim 19, wherein: the reel includes a core portion centered about the axis of rotation and disposed radially interior from an outer edge of the reel, and the braking member is positionable against an interior surface of the core portion.

21. The braking mechanism of claim 19, wherein: the reel includes a flange portion, and the braking member is positionable against the flange portion.

22. The braking mechanism of claim 19, wherein the braking member is connected to an end portion of the brake lever.

23. The braking mechanism of claim 19, further comprising:

a detent connected to the reel support member and configured to secure the brake lever in a first position, wherein the braking member is positioned against the reel with a first braking force in response to the detent securing the brake lever in the first position.

24. The braking mechanism of claim 23, further comprising:

a second detent connected to the reel support member and configured to secure the brake lever in a second position, wherein the braking member is positioned against the reel with a second braking force in response to the detent securing the brake lever in the second position.

25. The reel support member of claim 18, wherein the brake lever is configured to rotate about a pivot axis which is parallel to the axis of rotation.

* * * * *